US006434219B1

(12) United States Patent
Rothschild et al.

(10) Patent No.: US 6,434,219 B1
(45) Date of Patent: Aug. 13, 2002

(54) CHOPPER WHEEL WITH TWO AXES OF ROTATION

(75) Inventors: Peter Rothschild, Newton; Lee Grodzins, Lexington, both of MA (US)

(73) Assignee: American Science and Engineering, Inc., Billerica, MA (US)

( * ) Notice: Subject to any disclaimer, the term of this patent is extended or adjusted under 35 U.S.C. 154(b) by 0 days.

(21) Appl. No.: 09/912,229

(22) Filed: Jul. 24, 2001

Related U.S. Application Data

(60) Provisional application No. 60/220,274, filed on Jul. 24, 2000.

(51) Int. Cl.[7] ..... G21K 1/04
(52) U.S. Cl. ..... 378/160
(58) Field of Search ..... 378/160

(56) References Cited

U.S. PATENT DOCUMENTS 5,574,766 A * 11/1996 Panasik ..... 378/147

* cited by examiner

*Primary Examiner*—David P. Porta
*Assistant Examiner*—Elizabeth Gemmell
(74) *Attorney, Agent, or Firm*—Bromberg & Sunstein LLP

(57) ABSTRACT

An apparatus and method for creating a beam of penetrating radiation of specified cross section that raster scans over a two-dimensional area, using a chopper wheel rotated about two axes. The wheel has a set of apertures of which at least one is illuminated to form the beam. Rotary actuators rotate the wheel about an axis of rotational symmetry of the wheel and about an axis not parallel to the axis of rotational symmetry of the wheel.

18 Claims, 2 Drawing Sheets

CHOPPER WHEEL WITH TWO AXES OF ROTATION

The present application claims priority from U.S. Provisional Application, Serial No. 60/220,274 filed Jul. 24, 2000, which is incorporated herein by reference.

TECHNICAL FIELD

The present invention relates to a method and apparatus for creating a beam of electromagnetic radiation that raster scans over a two-dimensional area.

BACKGROUND OF THE INVENTION

The advantages of inspecting an object or a person with penetrating radiation, where the radiation is formed into a beam of specified cross-section and is scanned sequentially over a portion or the entirety of the object or person, are well known. Applications of a scanned x-ray beam, for example, include, but are not limited to, medical diagnostics and surveillance to detect concealed contraband materials at border crossings or sensitive sites.

A source of penetrating radiation typically emits a cone of radiation that may be formed, by means of collimators, into a fan beam that is narrower in one dimension and broader in a perpendicular dimension. In the prior art, if the beam to be scanned is a pencil beam, the fan beam emitted by the source is typically blocked by an attenuating material other than at an aperture of specified area where a beam is emitted that is scanned along one dimension, as described., for example, in U.S. Pat. No. Re 28,544 (Stein et al., reissued Sep. 2, 1975). In order to illuminate the entirety of a region, either the inspected object is translated with respect to the source (as baggage is typically moved on a conveyor belt for inspection), or else the source and scanning arrangement are translated with respect to the inspected object, as is known in the art of inspecting large objects such as cargo containers.

SUMMARY OF THE INVENTION

In accordance with one aspect of the invention, in one of its embodiments, there is provided a device for scanning a beam in two dimensions as a periodic function of time. The device has a wheel having an axis of rotational symmetry, the wheel being opaque to a specified energy range of electromagnetic radiation. The wheel has a set of apertures for transmitting the radiation in such a manner that the radiation is emitted in a beam from each of a specified number of apertures at a time. The device also has two rotary actuators. The first rotary actuator is coupled to the wheel for rotating the wheel about the axis of rotational symmetry of the wheel such that the beam is scanned in a plane perpendicular to the axis of rotational symmetry of the wheel. The second rotary actuator rotates the wheel about an axis not parallel to the axis of rotational symmetry.

In accordance with alternate embodiments of the invention, the specified number of apertures emitting a beam at any one time may be one. The device may also have a source of penetrating radiation for emitting radiation incident upon an inner surface of the wheel.

BRIEF DESCRIPTION OF THE DRAWINGS

The foregoing features of the invention will be more readily understood by reference to the following detailed description taken with the accompanying drawings.

DETAILED DESCRIPTION OF PREFERRED EMBODIMENTS

Figure 1:
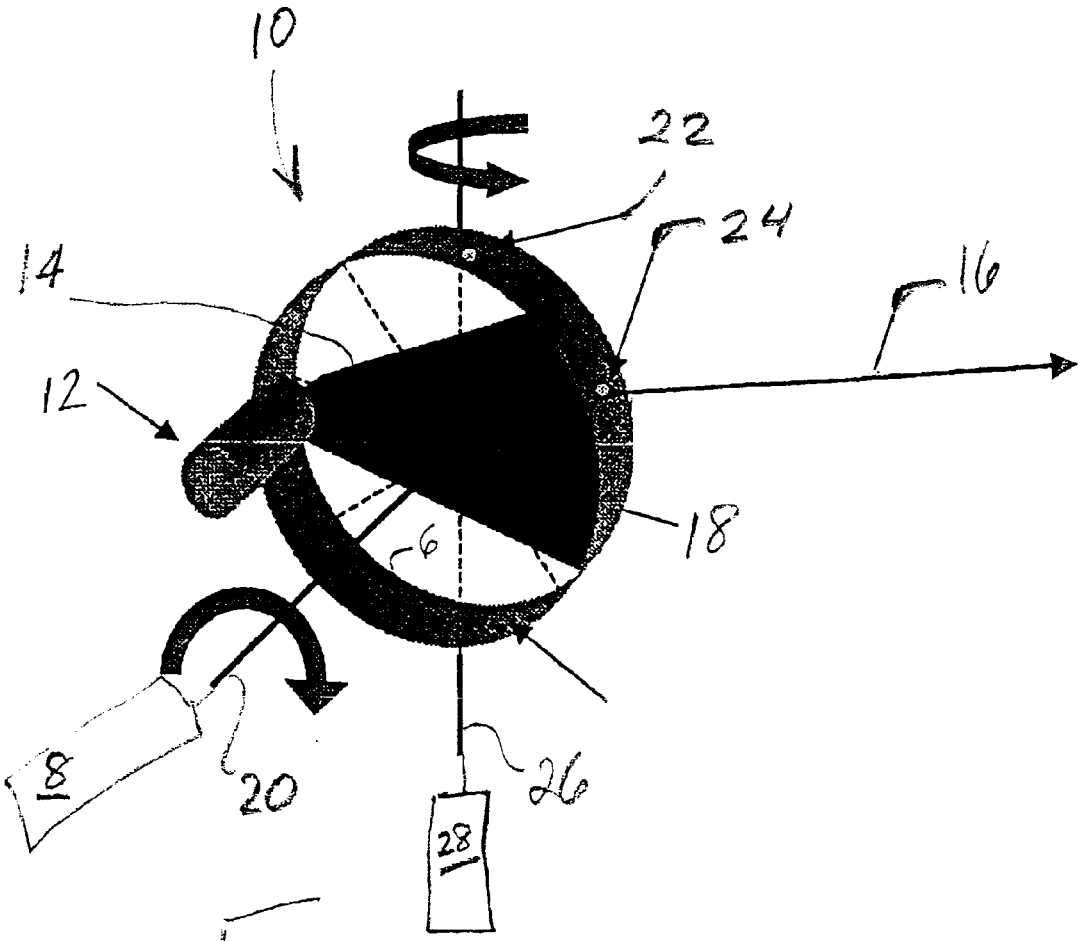
FIG. 1 schematic view of a dual-axis chopper for creating and scanning a pencil beam, wherein the source radiation is substantially perpendicular to the axis of rotational symmetry of the wheel, in accordance with a preferred embodiment of the present invention.

One method for generating a scanned beam of specified cross section employs a chopper wheel, as shown in FIG. 1 and designated there generally by numeral 10. Electromagnetic radiation is produced by source 12. For purposes of the present description, the electromagnetic radiation will be described as penetrating radiation, and, more particularly, as x-ray radiation, though it need not be so limited in the practice of the invention. Thus, source 12 may be an x-ray tube of any description.

Figure 2:
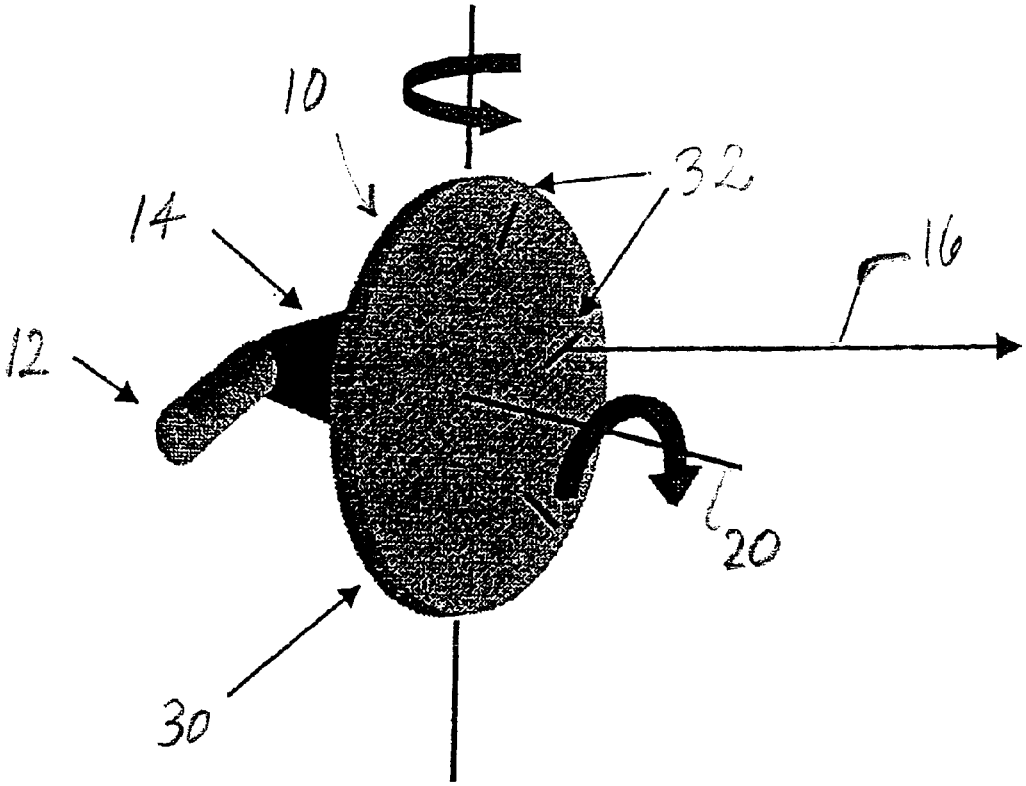
FIG. 2 is a schematic view of a dual-axis chopper having a perforated wheel, wherein the source radiation is substantially parallel to the axis of rotational symmetry of the wheel, for creating and scanning a beam in accordance with further embodiments of the present invention.

In accordance with preferred embodiments of the invention, in order to produce a beam 16 of specified cross-section, chopper wheel 10 may be in the form of an offset hoop 18. X-ray tube 12 is mounted off-axis inside rotating drum or hoop 18, where 'off-axis' refers to the position of a x-ray emitting target relative to the axis 20 about which hoop 18 rotates. Referring to FIG. 2, in accordance with alternate embodiments of the invention, chopper wheel 10 may also be a rotating disc 30 with slit apertures 32, or a rotating wheel with x-ray tube mounted at its center, as shown and described in U.S. Pat. No. 5,764,683, for example.

Referring again to FIG. 1, collimated fan beam 14 of x-rays is emitted from x-ray tube 12 and is incident on the inner surface 6 of the drum or hoop 18, in a direction substantially perpendicular to the axis 20 of rotational symmetry of the hoop. Hoop 18 is opaque to the impinging electromagnetic radiation in the energy range of the radiation. Thus, for x-ray radiation, hoop 18 may contain shielding by a heavy element such as lead. Hoop 18 also includes a number of apertures 22, 24 that are typically regularly spaced about its circumference. There is at least one such aperture 22 and the one or more apertures are referred to as a set of apertures herein and in any appended claims.

Apertures of differing size, shape, and spectral transmission characteristics are within the scope of the invention. As well, the apertures may include filters selected to attenuate a specified range of electromagnetic energies.

At any given time, only one of apertures 24 on the hoop is illuminated by the x-rays 14. All the x-rays 14 are absorbed in the lead shielding in hoop 18 except for the x-rays that can directly escape through illuminated aperture 24. These escaping x-rays form a pencil beam 16 whose direction is defined by the line between the center of the focal spot on the x-ray source target and the center of the illuminated aperture 24. Hoop 18 is rotated about its central axis 20 (called the "rotation" axis) by means of a rotary actuator 8 which may include a motor, for example. By virtue of rotation of hoop 18 about axis 20; the location of aperture 24 changes, and a scanning beam 16 of x-rays is created that follows the rotation of the hoop. The hoop rotation therefore creates a beam that scans along one dimension, i.e., in the plane that is perpendicular to axis 20. It is to be understood that the emission of multiple beams 16 simultaneously from a plurality of apertures 24 is also within the scope of the present invention as described and claimed herein.

To create a beam that raster scans over a two-dimensional area, hoop 18 is also rotated about a second axis 26 (called the "scan" axis) that may pass through the wheel center, but that is not parallel to the rotation axis 20. In a preferred embodiment, the scan axis is perpendicular to the rotation axis. The scan axis, however, need not be perpendicular to the rotation axis as the term "scan axis" is used herein and in any appended claims. Rotation about the scan axis 26 is effectuated by a rotary actuator 28 as known in the art, and the rotation may be complete or partial, within the scope of the present invention. The rate of rotation about the scan axis 26 is typically slower than the rate of rotation about rotation axis 20, so that successive scan lines are created as the wheel is slowly rotated about the scan axis. A scanning pencil beam that raster-scans over two dimensions in a manner periodic in time is therefore created by simultaneously rotating about the rotation axis and the scan axis.

Embodiments of the present invention may advantageously be employed, for example, in an x-ray backscatter system that scans the walls and ceiling of a room. The system is placed in the center of the room, with hoop 18 (called the "chopper wheel") spinning about a horizontal rotation axis at about 80 rpm. As the wheel rotates, pencil beam 16 scans in the vertical direction. To scan the entire room, the wheel and x-ray tube assembly is rotated very slowly about the scan axis, completing one revolution in about 5–10 minutes. The x-ray energy of such a system is preferably between 120 and 225 kV. This system may also be used to covertly detect weapons such as guns and knives concealed: on a person at distances of up to 10 feet.

In accordance with further alternate embodiments of the invention, an X-ray backscatter system is used for scanning people. The system is placed in front of a person at a distance of about 3 feet, with the wheel spinning about a horizontal rotation axis at about 100 rpm. As the wheel rotates, the pencil beam scans across the person in the vertical direction. To create a two-dimensional image, the wheel is rotated very slowly about the scan axis over an angular range of about 35 degrees, with the scan being completed in about 5–10 seconds. The x-ray energy of such a system is preferably between 80 and 140 kV.

In accordance with yet other embodiments of the invention, chopper wheel 18 rotates about the scan axis 26 but X-ray tube 12 remains stationary. In this case, X-ray tube 12 emits a wide fan beam 14 of X-rays (rather than a narrow, highly collimated fan beam), and the wide fan beam 14 is incident on the inside surface of a wide chopper wheel 18. An advantage of this embodiment is that fewer components need to be rotated about the scan axis. A major disadvantage of this embodiment is that the chopper wheel must be considerably wider, and contain a lot more lead shielding. This leads to a more expensive wheel, with a higher moment of inertia.

The described embodiments of the invention are intended to be merely exemplary and numerous variations and modifications will be apparent to those skilled in the art. All such variations and modifications are intended to be within the scope of the present invention as defined in the appended claims.

We claim:

1. A device for scanning a beam as a periodic function of time, the device comprising:

a. a wheel having an axis of rotational symmetry, the wheel being opaque to a specified energy range of electromagnetic radiation, the wheel having a set of apertures for transmitting the radiation in such a manner that the radiation is emitted in a beam from each of a specified number of illuminated apertures at a time;

b. a first rotary actuator coupled to the wheel for rotating the wheel about a rotation axis coincident with the axis of rotational symmetry of the wheel such that the beam is scanned in a plane perpendicular to the axis of rotational symmetry of the wheel; and c. a second rotary actuator for rotating the wheel about a scan axis not parallel to the axis of rotational symmetry of the wheel.

2. A device in accordance with claim 1, wherein at least one of the first and second rotary actuators is a motor.

3. A device in accordance with claim 1, wherein the scan axis is perpendicular to the rotation axis.

4. A device in accordance with claim 1, wherein the rotation about the rotation axis is faster than the rotation about the scan axis.

5. A device in accordance with claim 1, wherein the rotation about the scan axis subtends less than a full circular rotation.

6. A device in accordance with claim 1, further comprising a source of electromagnetic radiation for emitting radiation incident upon an inner surface of the wheel.

7. A device in accordance with claim 6, wherein the source of electromagnetic radiation is fixed relative to at least one of the rotation axis and the scan axis.

8. A device in accordance with claim 6, wherein the source of electromagnetic radiation is disposed at a specified offset from the rotation axis.

9. A device in accordance with claim 6, wherein the source of electromagnetic radiation is a x-ray tube that emits x-rays.

10. A device in accordance with claim 1, wherein the wheel includes lead.

11. A device in accordance with claim 1, wherein the wheel includes a drum.

12. A device in accordance with claim 1, wherein the wheel includes a hoop.

13. A device in accordance with claim 1, wherein the specified number of illuminated apertures is at least one.

14. A device in accordance with claim 1, wherein the set of apertures includes filters to attenuate a specified range of electromagnetic energies.

15. A device in accordance with claim 1, wherein the set of apertures is regularly spaced.

16. A device in accordance with claim 1, wherein at least one aperture from the set of apertures differs from at least one other aperture from the set of apertures in at least one characteristic selected from the group of size, shape, and transmission spectrum.

17. A method for scanning a beam in two dimensions as a periodic function of time, the method comprising:

a. illuminating a surface of a wheel with electromagnetic radiation to which the wheel is opaque other than at a set of apertures traversing the wheel in a direction of propagation of the electromagnetic radiation;

b. rotating the wheel about an axis of rotational symmetry of the wheel; and c. simultaneously rotating the wheel about an axis not parallel to the axis of rotational symmetry of the wheel.

18. A method in accordance with claim 17, wherein the orientation of the beam is scanned in a plane parallel to an axis of rotational symmetry of the wheel.

* * * * *